US007080716B2

(12) United States Patent
Cherpitel

(10) Patent No.: US 7,080,716 B2
(45) Date of Patent: Jul. 25, 2006

(54) MOVABLE FALL PREVENTION DEVICE FOR A BELAY SUPPORT

(75) Inventor: Laurent Cherpitel, Cranves Sales (FR)

(73) Assignee: S.S.E. S.p.A., Cisano Bergamasco (IT)

( * ) Notice: Subject to any disclaimer, the term of this patent is extended or adjusted under 35 U.S.C. 154(b) by 0 days.

(21) Appl. No.: 10/468,093

(22) PCT Filed: Jan. 30, 2002

(86) PCT No.: PCT/FR02/00353

§ 371 (c)(1),
(2), (4) Date: Feb. 2, 2004

(87) PCT Pub. No.: WO02/064215

PCT Pub. Date: Aug. 22, 2002

(65) Prior Publication Data

US 2004/0129494 A1 Jul. 8, 2004

(30) Foreign Application Priority Data

Feb. 14, 2001 (FR) ..... 01 01997

(51) Int. Cl.
*A62B 1/00* (2006.01)

(52) U.S. Cl. ..... 182/192; 182/5

(58) Field of Classification Search ..... 182/5, 182/192, 193; 188/65.1
See application file for complete search history.

(56) References Cited

U.S. PATENT DOCUMENTS

| | | | | | |
|---|---|---|---|---|---|
| 3,674,116 | A | * | 7/1972 | Vogeli | 188/67 |
| 4,265,179 | A | * | 5/1981 | Tupper et al. | 104/182 |
| 4,502,668 | A | | 3/1985 | Dodge, Jr. | 254/391 |
| 4,521,000 | A | | 6/1985 | Dodge, Jr. | 254/391 |
| 4,542,884 | A | | 9/1985 | Dodge, Jr. | 254/391 |
| 4,846,075 | A | * | 7/1989 | Tupper | 104/209 |
| 5,156,240 | A | * | 10/1992 | Ostrobrod | 188/65.1 |
| 5,265,696 | A | * | 11/1993 | Casebolt | 182/8 |
| 5,400,869 | A | * | 3/1995 | Rocourt | 182/133 |
| 5,638,919 | A | | 6/1997 | Pejout | 182/192 |
| 5,860,493 | A | | 1/1999 | Cherpitel | 182/65.2 |
| 5,934,408 | A | * | 8/1999 | Flux | 182/5 |
| 6,019,195 | A | | 2/2000 | Pelofi | 182/192 |

FOREIGN PATENT DOCUMENTS

| | | |
|---|---|---|
| FR | 2547006 | 12/1984 |
| FR | 2720283 | 12/1995 |

* cited by examiner

*Primary Examiner*—Alvin Chin-Shue
(74) *Attorney, Agent, or Firm*—Fay, Sharpe, Fagan, Minnich & McKee, LLP

(57) ABSTRACT

A movable fall-preventing device (1) for a belay support (6) includes an axis-retaining groove which retains the belay support (6) by means of a lever (16) that pivots between an open position and a closed position. One end of the lever comprises a locking cam and the other end is provided with a hole intended to receive a snap hook (5). An end stop system limits the pivoting movement of the lever (16) in an intermediary position when switching from the closed position to the open position. The end stop system comprises a retractable, movable stop (50).

10 Claims, 7 Drawing Sheets

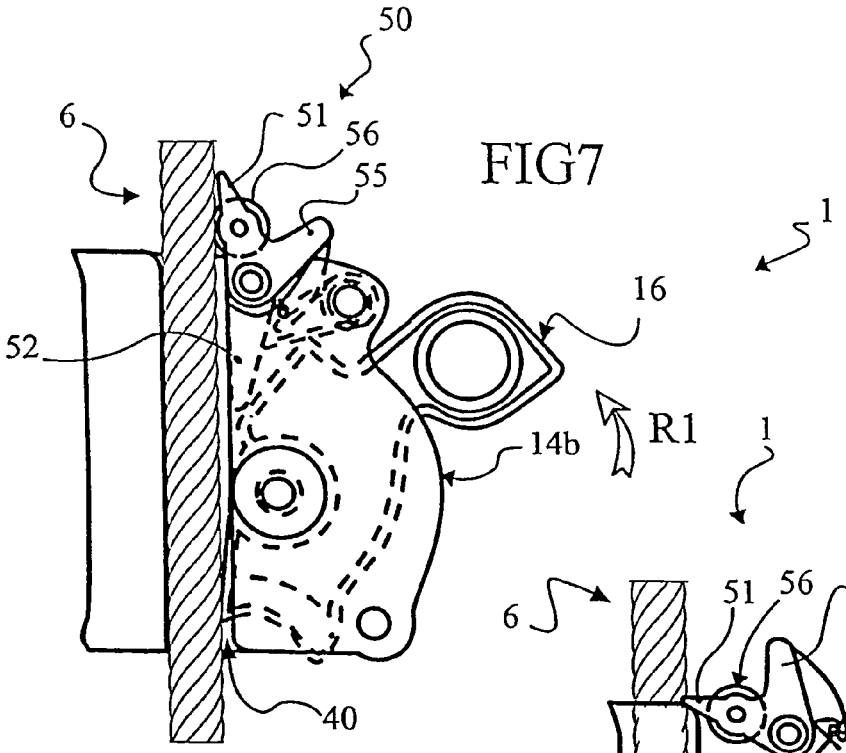
FIG7
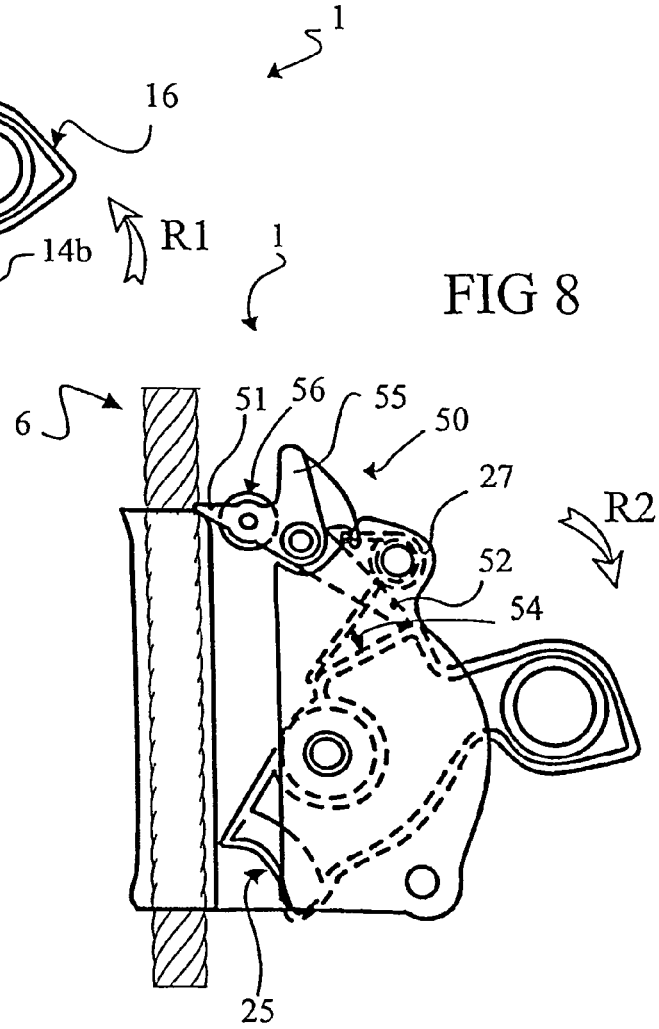
FIG 8
FIG 9
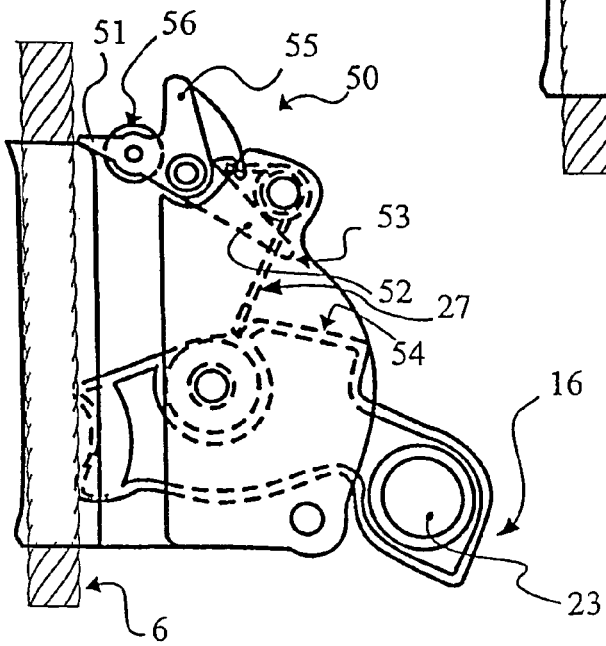

MOVABLE FALL PREVENTION DEVICE FOR A BELAY SUPPORT

BACKGROUND OF THE INVENTION

The present invention concerns an individual safety device for preventing falls from an altitude. It relates to a movable fall preventing device specifically adapted to flexible vertical safety supports.

Personnel, which have to intervene on high installations and who must, to that end, climb or descend the length of towers or poles, must have the assurance that they will not sustain untimely falls. This is, for example, the case with installers or repair personnel of installations such as cable cars or ski lifts. It is thus necessary to assure them that they can freely climb or descend without the risk of falling.

Such devices are already known, comprising a safety rope or safety cable, which is arranged vertically, also called a "life line," upon which the user relies in order to move in upward or downward direction. To that effect, the user is fitted with individual safety equipment connecting the user to the "life line" and comprising a harness attached to a movable fall-prevention device. The known devices, however, are not totally satisfactory when it comes to convenience and reliability.

The present invention proposes a new device, the implementation of which is particularly safe, reliable, and convenient.

SUMMARY OF THE INVENTION

Thus, the movable fall-prevention mechanism for safety lines according to the invention, of the type comprising a retention groove in which said safety support is retained by a lever pivoting between an open and a closed position. One of the extremities includes a blocking cam, and the other extremity comprises a hole, destined to receive a safety-clasp. A stop-system limits the pivoting of the lever in the intermediary position when passing from a closed position toward an open position. The stop-system is comprised by a movable stop.

According to the complimentary characteristics, the stop is mobile in pivoting and is, according to the preferred embodiment, comprised of a pivoting pawl induced by a spring the in the active position of the stop.

According to another characteristic, the stop is comprised by the end of a shorter arm of the pivoting pawl, the aforementioned end being destined to cooperate with the surface of the stop lever to determine its intermediary position.

Let us add that the pawl is mounted pivoting around the transverse axis laid out in the higher part of the fall-prevention mechanism, while it is induced by a spring which, advantageously, also operates the pivoting lever.

According to the embodiment given in the title example, the retention groove is realized by the wall of the main guide plate and comprises a secondary guide plate, constituted by a wall, while the lever is mounted pivoting between the two guide-plates.

The fall-prevention mechanism of the invention comprises a longitudinal passage and parallel to the grove. The aforementioned passage is limited laterally by, in one way, the first border of the principle guide plate and, in the other direction, by the first border of the second guide plate.

Other characteristics and advantages of the invention are evident from the description below bases on the attached drawings. These are provided by way of examples and are not limited thereto.

BRIEF DESCRIPTION OF THE DRAWINGS

FIG. 3 is a plane view, FIG. 4 is lateral view of the side of the lever while FIG. 5 is a cross-section according to A—A.

FIGS. 7 to 11 illustrate the different stages of putting into place the fall-preventing mechanism according to the invention.

DETAILED DESCRIPTION OF THE PREFERRED EMBODIMENTS

Figure 1:
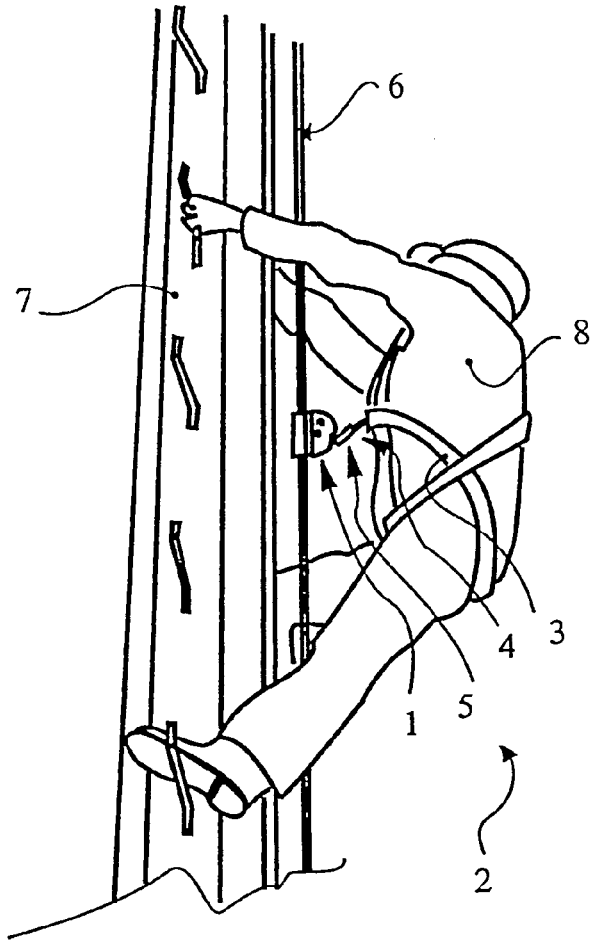
FIG. 1 is a view of the entire unit, illustrating how the fall-prevention mechanism of the invention is utilized.
Figure 2:
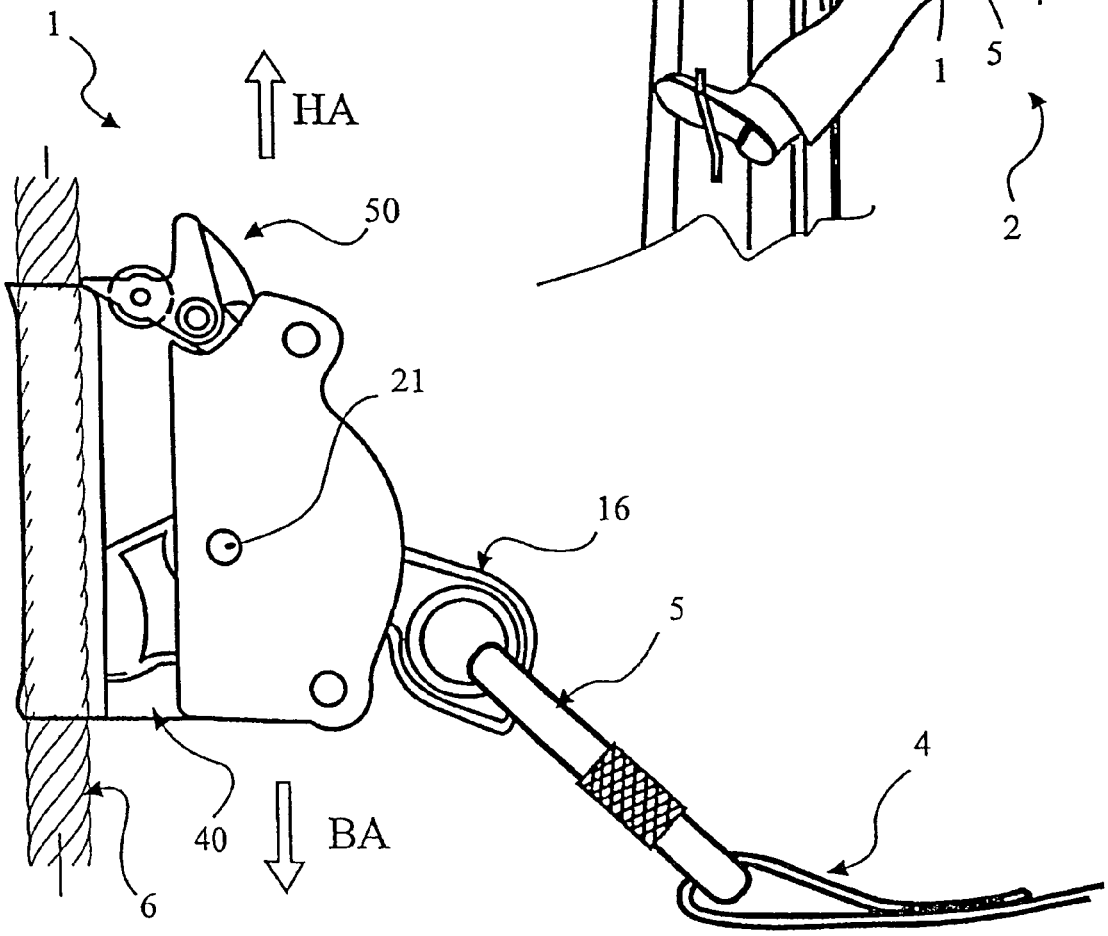
FIG. 2 is a lateral view, representing more specifically the fall-prevention mechanism mounted on the safety cable and its connection with the harness worn by the user.
Figure 3:
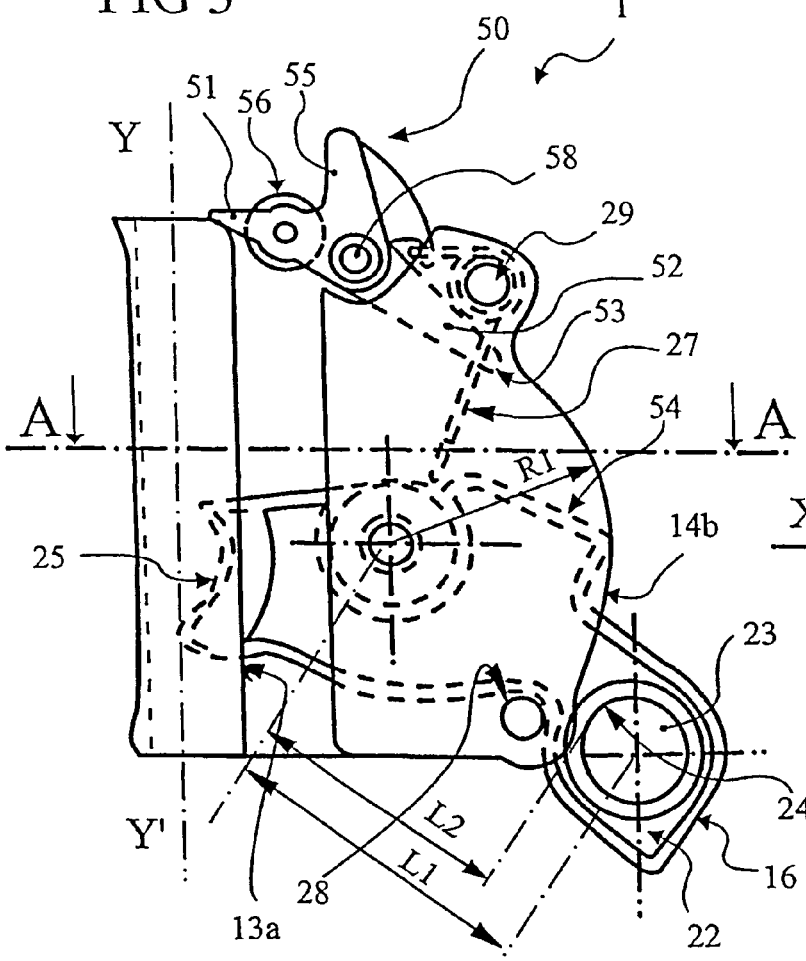
FIGS. 3, 4, and 5 are execution views of the fall-preventing mechanism.
Figure 4:
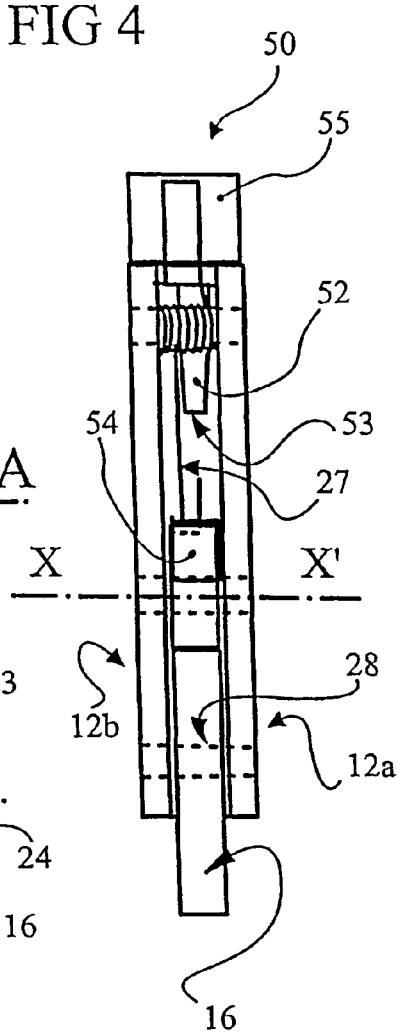
Figure 5:
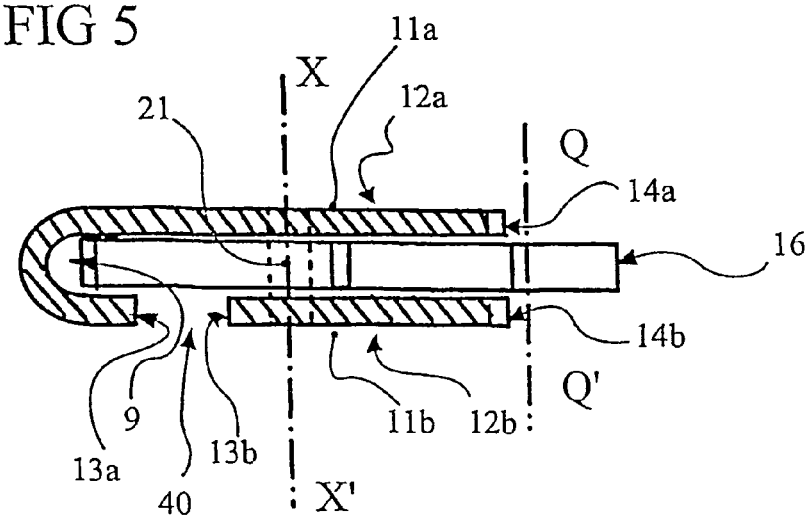

A movable fall-preventing mechanism 1 is part of the individual protection equipment against falls from height, bearing the general reference number 22. In addition to said fall-prevention mechanism 1, a harness 3, has at least one fastening buckle 4 with a safety catch for hook-up 5. A fall-preventing mechanism 2 is configured to be connected in detachable fashion to a fixed vertical safety support 6, for example to an intervention tower 7.

In its utilization position, that is to say, connected to the harness 3, the movable fall-preventing mechanism 1 can be moved, at will, in and upward direction (HA) or in a downward direction (BA) by means of normal sliding (that is, at the speed of ascent or descent of the user) along the length of the vertical cable or cord 6 constituting the safety support. In the event of a fall, which corresponds to an accelerated rate of descent, the movable fall-preventing mechanism locks itself on the cable. One comprehends that the user 8 can thus climb and descend the length of the tower 7 by letting the fall-preventing mechanism slide upward (HA) or downward (BA) along the length of the safety bale 6, which required, while he has the assurance that he will not fall downward as a result of the blockage of his fall-preventing mechanism 1 against said cable 6 constituting his safety support.

The fall-preventing mechanism 1 comprises, in essence, a recesses, rectilinear profile 9 destined to receive the safety cable 6 which is held in place after engagement by a movable, pivoting cam 10. Thus, the recessed profile 9 is constituted by wall 11*a* of a principle guide-plate 12*a* whose first lateral edge 13*a* is rolled up parallel to said wall in a manner so as to form a semi-circular gutter or groove 9, while the second lateral edge 14*a* is in the plane of the wall and is curved. It is noted that the groove has a semi-circular profile according to the vertical axis (YY') and has the approximate dimension of the cable destined to be arranged in it. Furthermore, the blocking cam 10 is an integral part of a handling and fastening lever 16 which is mounted movably, in pivoting motion on the fall-preventing mechanism around a transverse axis (XX').

It should be noted that the second lateral edge 14*a* comprises a lower slope, sensibly circular, with radius (R1) centered on axis (XX').

The movable fall-preventing mechanism includes, furthermore, a principle guide-plate 12*a*, described earlier and forming groove 9 a secondary guide-plate 12*b*. The latter is integrally joined to the principal guide-plate so that it is parallel and spaced at a distance to constitute, on the one hand, a space between the two guide plates, destined for movement of lever 16 and, on the other hand, a longitudinal passage or slot 40 for receiving of the cable 6. The secondary guide-plate has an identical configuration to wall lib of the principle guide-plate 12*a*. Thus, it is constituted by a wall 11*b* and comprises a first lateral, rectilinear edge 13*b*, while the second lateral edge 14*b* is in the plane of the wall and is curved to constitute a lower slope, sensibly circular, with radius (R1) centered on the axis (XX'). We are adding that the passage 40 is limited laterally by the first edge 13*b* of the principle guide-plate 12*a* and the first edge 13*a* of the secondary guide-plate 12*b*. It goes without saying that the width of the passage is greater than the diameter of the cable 6 destined to be engaged with it, said passage extending parallel to axis (YY') of the groove.

The previously cited lever 16 is arranged in movable fashion, pivoting around transverse axis (XX'). It is arranged to move between the two guide plates 12*a*, 12*b* in a space (e) formed between the principle guide plate 12*a* and the secondary guide-plate 12*b*. It is thus mounted rotatably around an axis 21 extending between the two guide-plates so that its engagement extremity 22 extends beyond the slopes 14*a*, 14*b* of the guide-plates 12*a*, 12*b*. Said non-engaged extremity 22 comprises in addition an attachment hole 23 destined to receive the safety catch 5 which can be engaged. The attachment hole 23 is cylindrical and its axis (QQ') is at a distance (L1) from the higher axis (XX') has the value of the radius (R1) of the slope in addition to the radius of the aforementioned hole 23 so that its peripheral wall 24 is at a distance (L2) from axis (XX') greater than the radius (R2).

Figure 6:
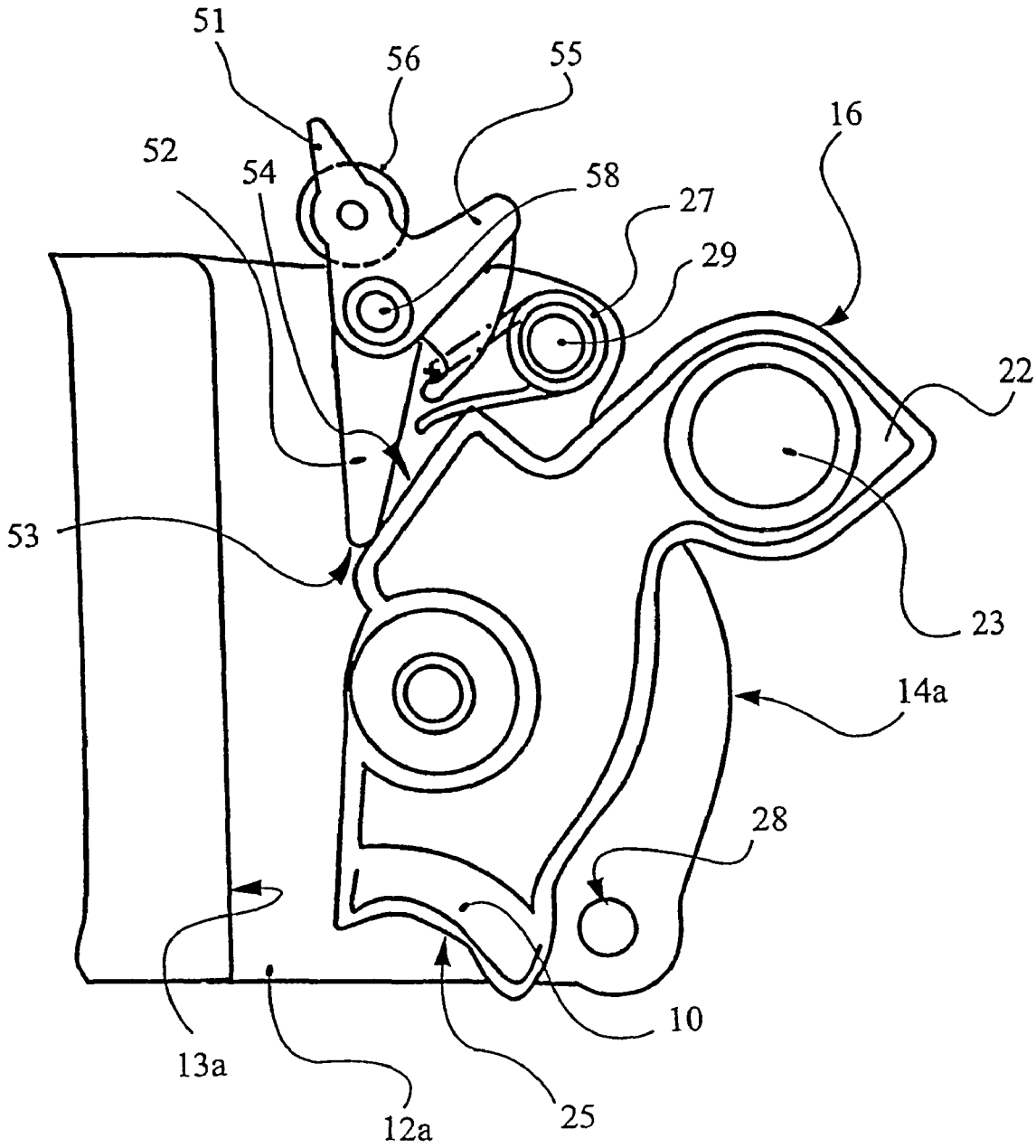
FIG. 6 is a similar view to FIG. 3, but illustrating the fall-preventing mechanism in its extreme open position, showing the various elements constituting the fall-preventing mechanism, the secondary guide plate being withdrawn for a better understanding of the drawing.

In addition, the lever 16 comprises on the side opposite the attachment hole 23 a cam 10 constituted by a stopping slope 25 to assure blockage of the fall-preventing mechanism 1 on the safety support. The lever 16 can, through rotation around axis (XX') assume two extreme positions, an open position, as illustrated in FIGS. 6 and 7, and a closed position as represented in FIGS. 3, 9, 10, and 11.

It is further indicated that the fall-preventing mechanism comprises two stops 28, 29 in order to limit the angular displacement of the lever downward by a lower stop 28 and upward by and upper stop 29. The lower stop 28 is realized by a cylindrical spacer extending between the two guide-plates 12*a*, 12*b* in the lower zone, while the upper stop 29 is realized by an upper cylindrical cross-piece, linking the upper portion of the two guide-plates 12*a*, 12*b*.

It should be noted that the lever is constantly biased toward its closed position by a torsional spring 27. The latter is useful, on the one side, in keeping the fall-preventing mechanism 1 in place on the safety cable 6 at the moment it is put in place and for withdrawal of the safety catch 5, and, on the other side, in order to assure blockage of the fall-preventing mechanism in case of a fall, and that, even prior thereto, the safety catch has to guaranty, by itself, the pivoting of the lever in the downward direction.

According to the invention, it is anticipated that a body of the retractable mobile fall-preventing mechanism 50 for the lever 16 intended to limit its upward rotation into a intermediary position not permitting the safety support to leave the fall-preventing mechanism, which is comprised by a pivoting pawl 50 induced to close by the spring 27. The aforementioned pawl is intended, on the one hand, to limit the pivoting of the lever into an intermediary position, and on the other hand and simultaneously, has to prevent, by its form, the inopportune release of the safety support 6 from the passage 40.

The pawl is constituted of three arms known as: a lateral arm 51 intended to prevent the inopportune release of the safety support 6 by way of the passage 40, a lower arm 52 intended to limit the upward pivoting of the lever 16 in the intermediary position, as well as an upper action arm 55. The lower arm 52 being used as a stop for the lever thanks to its lower end 53 intends to cooperate with the upper surface of the stop 54 of the lever 16. The pawl, thanks to its lateral arm 51, constitutes an obstacle preventing the inopportune release of the safety support through the passage 40. The pawl, constituting a double security system, is induced, in its active stop and closure position, by a spring 27 which is advantageously the same spring that actuates the lever 16.

The pawl is mounted to rotated around a transverse axis 58 laid out between the principle guide-plate and the secondary guide-plate in the upper portion of the fall-preventing mechanism appreciably in the prolongation of the upper edge 13*b* of the secondary guide-plate, so that the upper part of the pawl extends beyond the edge 13*b* until it reaches the edge 13*a*, thus closing the passage 40. When the pawl is in the stop position, it blocks the passage 40 and conversely.

The pawl is mobile and retractable between a position known as "safety" blocking the passage 40 and limiting the rotation of the lever into its intermediary position, and a position of inactive release. The user, by a simple action on the pawl, simultaneously actuates the two safety systems to be able to introduce the safety support, while making to pass the lever from its intermediary position towards its upper position. Let us add that the afore mentioned pawl can be advantageously equipped with a caster 56 on the level of its upper arm to ensure a better guidance of the safety support to the level of the upper end of the groove 9.

FIGS. 7 to 11 illustrate the different stages of putting into place the fall-preventing mechanism according to the invention.

The user, while holding the first guide-plate 12*a* of the fall preventing mechanism 1 in the palm of his right hand, causes, with his thumb, the lever 16 to pivot in an upwards direction according to R1 in order to disengage the passage 40 for the cable; while maintaining the pawl 50 in its inactive position, he introduces the fall preventing mechanism 1 onto the cable 6 to let said cable 6 pass via the passage 40 as is illustrated in FIG. 7.

Then the user engages the cable 6 into the groove 9 and releases the lever 16 and the pawl 50 as is illustrated in FIG. 8. The lever 16, acted upon by the spring 27, pivots in a downward direction according to (R2) until the locking face 25 grips the cable, while retaining it thus in the groove 9, as is represented in FIG. 8, the pawl also blocks the passage 40 by its lateral arm 51.

Figure 10:
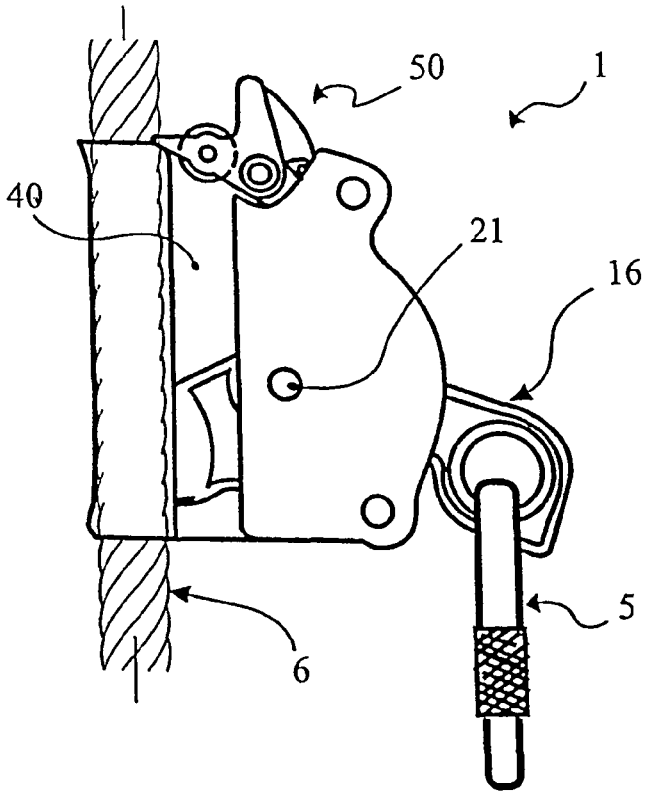

The user then installs a safety catch 5 and engages it in the hole 23 of the lever 16 as is illustrated in FIG. 10. He then attaches his harness 3 to the safety catch, for instance through an intermediary of fastening buckles 4 as shown in FIG. 11.

Figure 11:
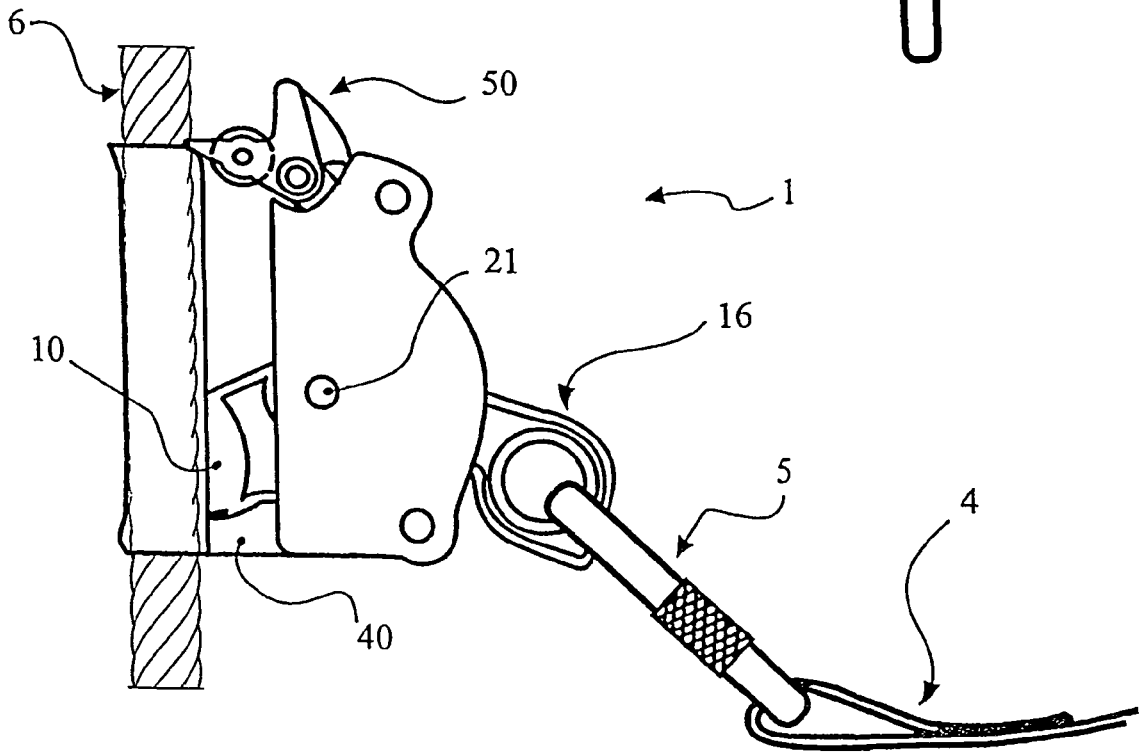
Figure 12:
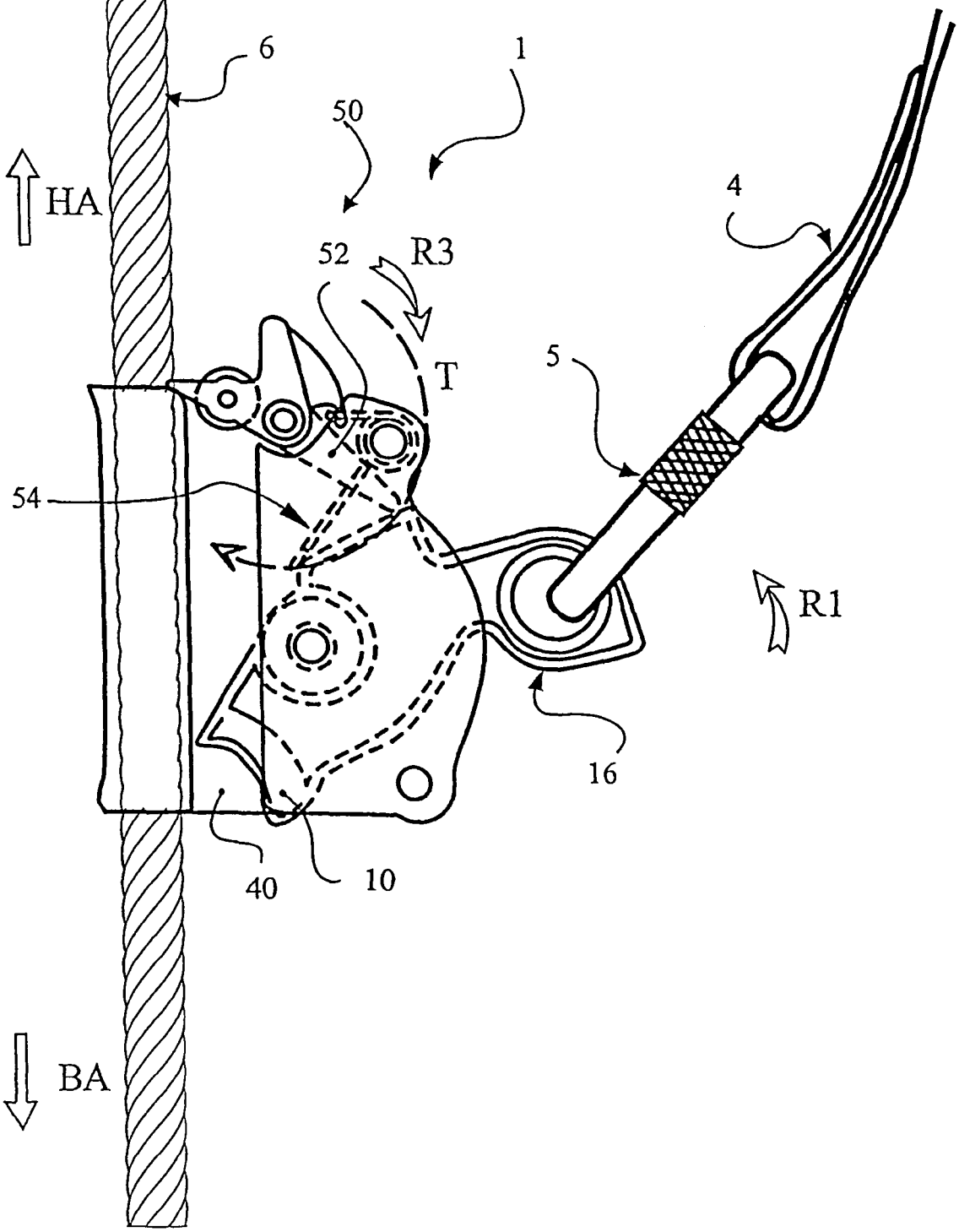
FIG. 12 represents how the fall-preventing mechanism according to the invention is utilized.

In the position illustrated in FIG. 11, the fall-preventing mechanism 1 is blocked against any untimely descent downwards (BA), preventing a fall on the part of the user, but it can be moved in an upward direction (HA) until its intermediary stop position against the pawl, by rotation in upwards direction according to (R1) of the lever 16 as is illustrated in FIG. 12.

While climbing, the user causes the lever 16 to pivot towards the top (HA) according to (R2). In that position, the lever precludes all possibility of the cable leaving the groove 9 and any slacking of the lever, which pivots again toward the bottom according to (R1) which causes locking on the cable by the fall-preventing mechanism.

While descending, the weight of the fall-preventing mechanism 1 and the spring permit biases the lever 16 to rest, abutting against the stop 53.

Thus, the user is able to descend without engagement of the fall-preventing mechanism 1. In case of a fall or unnatural descent, the lever 16 pivots in a downward direction (BA) according to (R1) so that the locking face 25 grips the cable 6.

According to the above description, it is apparent that the fall-preventing mechanism comprises a system of movable and retractable stops 52, 53, 54 which limit the pivoting of the lever in an intermediary position when the user passes this lever from the closed position towards the open position. It is then impossible for the cable to leave the retention groove, with the cam 10 still being engaged in the retention zone of the cable, as is evident from FIG. 12.

In the intermediary position of FIG. 12, one notes that there is some play between the cable and the cam 10 which permits free sliding toward the top (HA) and toward the bottom (BA). However, in case of a fall, the fall-preventing mechanism 1 immediately returns to its blocking position as illustrated in FIG. 11.

In addition, the fall-preventing mechanism is beneficially made of metal such as, for example, stainless steel or any other appropriate material.

It will be noted that in the use position, the user can not pivot the pawl 50 in the direction R3, because the end of the lower arm 52 is stopped against the upper surface 54 of the arm and its trajectory (T) is blocked, as clearly appears in FIG. 12. Thus, the locking position of the pawl closes the passage 40, which is an additional safety means.

Figure 13:
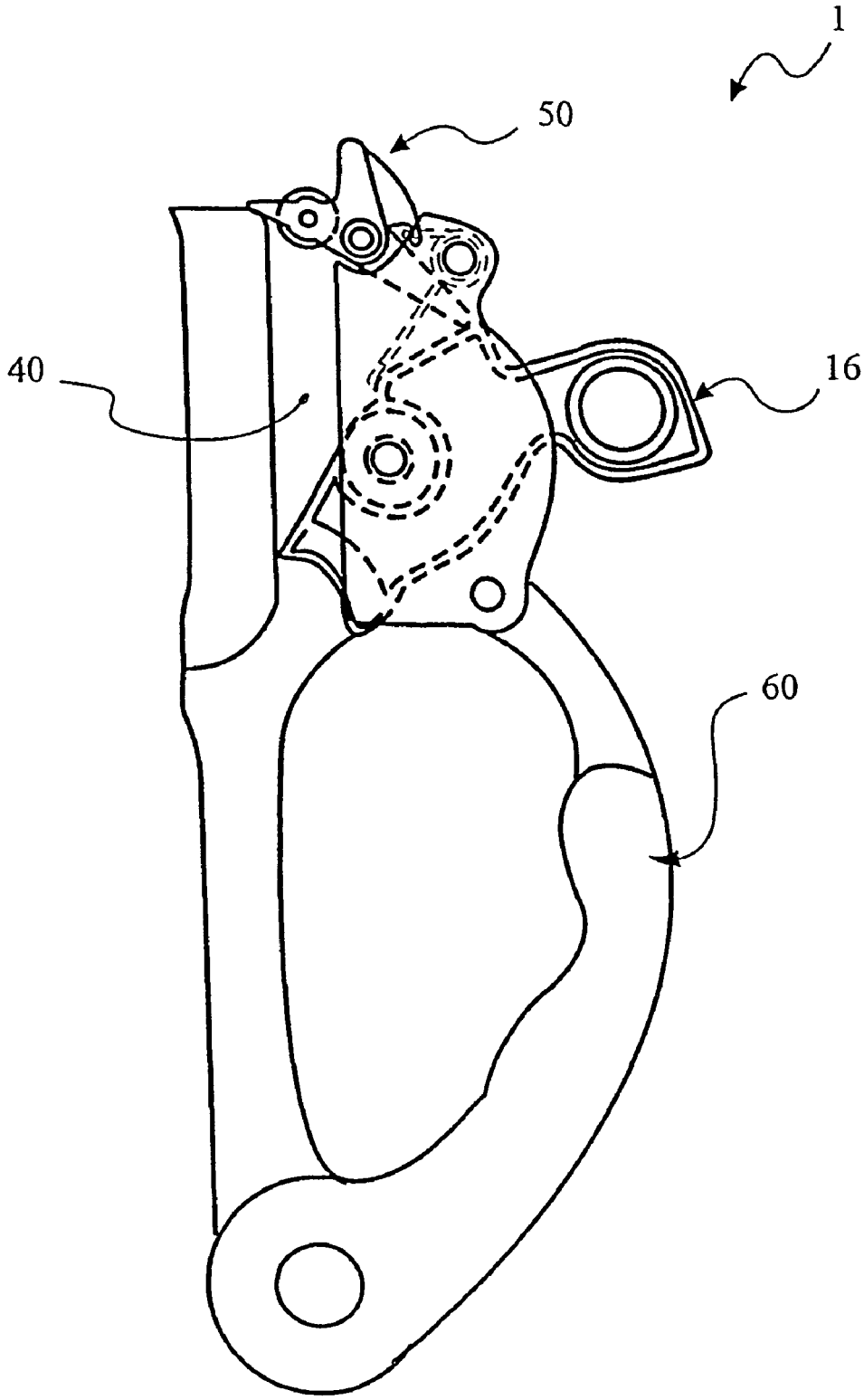
FIG. 13 illustrates a variation of the embodiment.

FIG. 13 is a lateral view illustrating another embodiment according to which the fall-preventing mechanism 1 is prolonged toward the bottom by a grip 60. The aforementioned grip forms a loop sufficiently large and rigid, to constitute an ascension grip that the user will be able to clutch in order to rise to the top, by pulling on the fall-prevention mechanism. One will add that thanks to the fall-preventing mechanism of the invention, the user can also move downwards without risk of losing his lifeline, this being owed to the fact that the passage 40 is closed.

Needless to say, the invention is not limited to the embodiments described by way of examples, but it includes also all equivalent versions as well as their combinations.

The invention claimed is:

1. A fall-preventing mechanism including:

walls that define a longitudinal groove through which a safety cable passes and a longitudinal slot through which the safety cable is loaded into and removed from the longitudinal groove;

the walls supporting a pivoting lever having a safety cable engaging cam, the lever being pivotable between (1) an open position in which the safety cable is receivable through the slot into the groove, (2) an intermediate position in which the lever extends across a lower portion of the slot, and (3) a locking position in which the cam engages the safety cable and prevents downward longitudinal movement of the fall-preventing mechanism relative to the safety cable; and a pawl pivotally mounted to the walls adjacent an upper end of the slot to pivot between a first orientation for receiving the cable through the slot and a second orientation during use, the pawl having:

a lateral arm which permits the cable to be received in the slot in the first orientation and which extends across and closes the upper end of the slot to prevent the safety cable from entering or exiting through the slot in the second orientation, and a lower arm which blocks the lever from pivoting past the intermediate position toward the open position in the second orientation and which permits the lever to rotate to the open position in the first orientation.

2. The fall-preventing mechanism according to claim 1, wherein the pawl is biased by a spring toward the second orientation.

3. The fall-preventing mechanism according to claim 2, wherein an end of the lower arm of the pawl is configured to cooperate with a stop surface of the lever for setting its intermediate position.

4. The fall-preventing mechanism according to claim 2, wherein the spring also acts on the pivoting lever.

5. The fall-preventing mechanism according to claim 1, wherein the walls which define the longitudinal groove include a principal guide-plate and a secondary guide-plate, the lever being pivotally mounted between the two guide-plates.

6. The fall-preventing mechanism according to claim 5, wherein the longitudinal slot is laterally limited by, on one side, a first edge of the principal guide-plate and, on the other side, a first edge of the second guide-plate, when the pawl is in the first orientation and the lever is in the open position, the safety cable is free to pass through the longitudinal slot, and when the pawl is in the second orientation and the lever is in one of (1) the intermediate position, (2) the closed position, and (3) between the intermediate and closed positions, the lever blocks the safety cable from passing through the longitudinal slot.

7. The fall-preventing mechanism according to claim 1, wherein the cam defines a blocking slope which engages the safety cable in the closed position.

8. The fall-preventing mechanism according to claim 6, wherein a width of the lever is such that it projects beyond each of the guide-plates.

9. The fall-preventing mechanism according to claim 1, wherein the pawl includes the lower arm, the lateral arm, and an action arm.

10. The fall-preventing mechanism according to claim 9, wherein the lateral arm includes a caster.

* * * * *